United States Patent [19]

Balan et al.

[11] 4,128,091

[45] Dec. 5, 1978

[54] HALL EFFECT ELECTRONIC IGNITION CONTROLLER WITH PROGRAMMED DWELL AND AUTOMATIC SHUT-DOWN TIMER CIRCUITS

[75] Inventors: Isadore Balan, Oak Park; Joseph J. Kopera, Trenton, both of Mich.

[73] Assignee: Chrysler Corporation, Highland Park, Mich.

[21] Appl. No.: 742,824

[22] Filed: Nov. 18, 1976

[51] Int. Cl.[2] ..... F02P 3/04

[52] U.S. Cl. ..... 123/148 E

[58] Field of Search ..... 123/148 E, 117 R, 146.5 A; 315/209 T, 209 SC

[56] References Cited

U.S. PATENT DOCUMENTS

| | | | |
|---|---|---|---|
| 3,297,009 | 1/1967 | Sasaki et al. | 123/148 E |
| 3,861,370 | 1/1975 | Howard | 123/148 E |
| 3,906,920 | 9/1975 | Hemphill | 123/148 E |
| 3,990,417 | 11/1976 | Tershak | 123/148 E |
| 4,036,198 | 7/1977 | Howard | 123/148 E |

*Primary Examiner*—Samuel Feinberg
*Attorney, Agent, or Firm*—Baldwin & Newtson

[57] ABSTRACT

An electronic ignition controller operable from a Hall Effect pickup Device in a ballast-resistorless, inductive-type ignition system for an automotive vehicle internal combustion engine and featuring programmed dwell and automatic shut-down timer circuits, which control current dissipation in the ignition coil. The programmed dwell timer circuit enables energization of the ignition coil for a controlled or substantially constant period of time over substantially the entire range of engine operating speeds up to a predetermined high engine speed above which the ignition system reverts to a constant duty cycle characteristic determined by the character of the triggering input or pickup device. The automatic shut-down timer circuit operates to block the energization of the ignition coil if the controller remains in a state of conduction that maintains the ignition coil energized for a predetermined prolonged period of time that is greater than the actual dwell period or ON time of the coil at low engine or cranking speeds.

24 Claims, 4 Drawing Figures

HALL EFFECT ELECTRONIC IGNITION CONTROLLER WITH PROGRAMMED DWELL AND AUTOMATIC SHUT-DOWN TIMER CIRCUITS

BACKGROUND OF THE INVENTION

This invention relates to electronic ignition controllers for internal combustion engines of automotive-type vehicles and, more particularly, to a low-cost, reliable electronic ignition controller, which is triggerable from a breakerless or velocity-insensitive Hall Effect pickup Device and is designed for use with a standard-type automotive ignition coil in a ballast-resistorless, inductive-type ignition system.

Prior forms of ignition controllers exhibiting some of the above characteristics are represented by U.S. Pat. Nos. 3,705,988; 3,861,370; 3,875,920 and 3,906,920, none of which, however, makes any provision for protection of the ignition coil from damage due to excessive current dissipation at low speed engine operation and/or during stalled engine or delayed starting conditions.

The invention seeks to avoid the above deficiencies in automotive vehicle-type ignition systems, which do not employ a ballast resistor, and seeks in other ways to provide a simple, reliable and low cost electronic ignition controller

SUMMARY OF THE INVENTION

Towards the accomplishment of the above and related objects, the invention provides an electronic ignition controller which is especially suited for use with a Hall Effect-type switching Device and features a pair of timing switching circuits using programmed unijunction transistors for providing a programmed dwell timer circuit and an automatic shut-down timer circuit. The programmed dwell timer circuit provides a delay characteristic, which delays for a fixed or variable controlled delay period, the turn-on or energization of the ignition coil from a triggering signal applied to the input of the controller. The delay period is a function of engine speed and, in the embodiment presented herein, may vary accordingly to provide a substantially constant period of coil energization sufficient to charge the coil over a wide range of engine operating speeds without impairment to the dwell period of the controller at high engine speeds.

The automatic shut-down timer circuit senses whether the ignition controller is in a state of conduction that permits the ignition coil to be energized from the vehicle electrical current source and operates to change the conductive state of the controller and to block the energization of the ignition coil only if the controller is in and remains in the aforesaid state of conduction for a predetermined prolonged period of time that is greater than the dwell period or ON time of the coil at the lowest of engine speeds, say at engine cranking speeds of around 50 rpm.

The internal design of the controller further includes protective circuits for the ignition coil connected to its output, for the Hall Effect Generator or pickup trigger Device connected to its input and for the internal semiconductor components employed therein from the otherwise damaging effects of positive and negative going transients appearing on the electrical supply conductors and from the effects of high voltages induced in the coil and appearing at the output semiconductor switching device under unloaded coil conditions.

The above and other objects, features and advantages of the invention, together with the manner in which they are realized, will appear more fully from consideration of the following detailed description made with reference to the accompanying drawings.

DESCRIPTION OF THE PREFERRED EMBODIMENT

Figure 1:
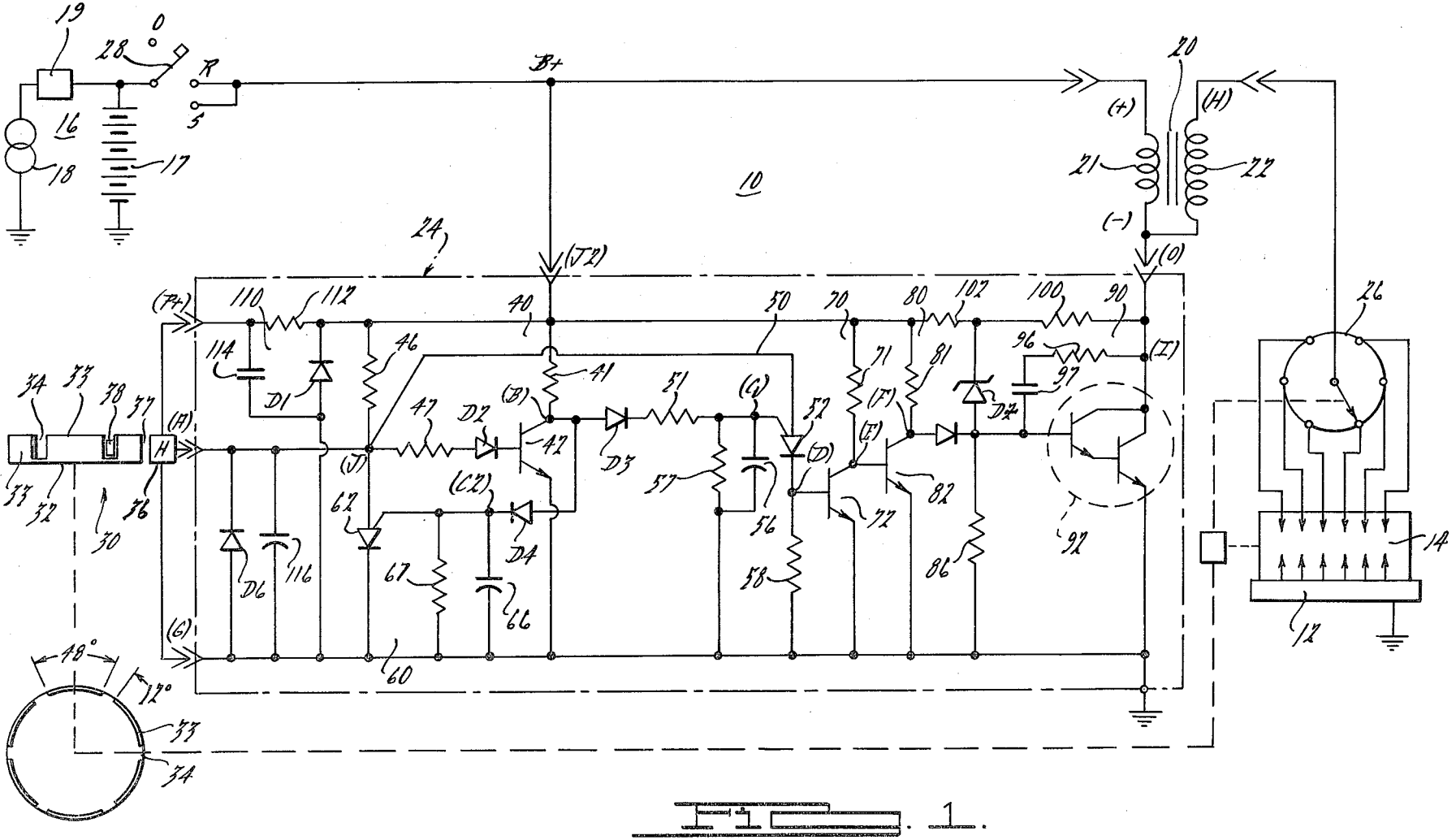
FIG. 1 is an electrical schematic circuit of the electronic ignition controller in accordance with the present invention.

Referring to the drawings, FIG. 1 illustrates in electrical schematic form a breakerless ignition system 10 for a multi-cylinder, internal combustion engine 12 having a plurality of sparking-type firing devices 14 for igniting the fuel-air mixture conducted to the individual engine cylinders for combustably powering the engine. The ignition system is of the inductive storage-type in which energy from a low-tension electrical current source 16 is inductively stored in the field of an ignition coil 20 whose primary winding 21 is periodically interrupted by a mechanical or electronic control switch unit 24 to collapse the field and induce high tension energy therein. The high tension energy extracted from the secondary winding 22 of the ignition coil is supplied from its high tension output terminal H and is sequentially distributed to the individual spark plugs 14 of the engine through distributor device 26 driven from and at one-half engine speed.

The primary winding 21 of the ignition coil is shown connected at its plus (+) terminal through a manually operable control switch 29 to the elevated or plus potential side of the low tension D.C. electrical current source 16, which includes a negatively-grounded storage battery 17 charged from an alternator-rectifier 18 and associated voltage regulator 19. The negative terminal (−) of the ignition coil, common to one side of the secondary and primary windings thereof, is connected to the negatively-grounded side of the source 16 through the interrupter or control unit 24, which, in the apparatus of the present invention, is of the breakerless electronic switch variety triggered from a pickup Device 30 operated in synchronism with the engine.

The pickup 30 is shown as contained in the distributor 26, and includes a pair of relatively movable elements such as a trigger or shutter wheel 32 driven in synchronism and at one-half engine speed past an electrical sensor device 36. In the preferred form of the invention the pickup is of the velocity insensitive variety, and the sensor 36 is a Hall Effect generator or switching device, which exhibits a bi-stable switching conductivity or impedance characteristic when the sensor is alternately exposed to and removed from the influence of a constant intensity radiation source 38, as a permanent magnet. Sensor 36 is spaced from the magnet by an air gap 37 in which is interposed a portion of the rim or periphery of the trigger or shutter wheel 32, which is of a cup-shape formation with a plurality of arcuately spaced, ferrous metal vanes 33 and arcuate slots or windows 34 formed about the periphery thereof and functions as a field gating or shunting element, successively interposing a metallic vane or field shunting portion 33 followed by an aperture, window or cutout portion 34 between the stationary magnet 38 and the Hall Device 36.

In the illustrated embodiment of the invention, the shutter wheel 32 has a total of six shunting elements or vanes 33, one of which is provided in each 60° sector thereof or for each cylinder or firing event in the engine 12. Each vane spans an arcuate distance of 48 mechanical degrees and each slot or window 34 spans an arcuate distance 12°, whereby the shutter wheel may be characterized as an 80% shutter wheel, providing a duty cycle of 80%. Such a duty cycle will provide in the controller a dwell period of sufficient duration, viz., 3.2 milliseconds, for adequate charging of the ignition coil at a high engine speed of 5,000 rpm for a six cylinder engine.

However, at low engine speeds of, say, 500 rpm for example, it will be noted that 80% duty cycle shutter will cause the coil to be charged for 32 milliseconds, which will be seen to cause excessive current dissipation therein. Such current dissipation is eliminated in accordance with the programmed dwell timer circuit feature of the present invention without the use of a ballast resistor, as will more fully appear later herein.

Continuing with the description of the Hall Effect Device 36, the latter has a high potential and a low potential terminal, P and G, which are adapted to be connected to the high potential side and to the low potential side respectively, of a source of d.c. operating potential, and when so connected, develops between a third or output terminal A and its reference or low potential G, a constant amplitude, essentially rectangular electrical pulse signal. The output signal from or appearing at terminal A of the Hall Effect Device is shown in FIG. 2A herein and has a pulse repetition rate, which is related to the product of one-half the engine speed and the number of engine cylinders and which is of a fixed duty cycle or ON/OFF ratio in terms of distributor angle or percentage of the ignition cycle.

Thus, when a metallic vane 33 is interposed in the air gap 37 between the permanent magnet 38 and the Hall sensor Device 36, the conductivity of the latter is low and the voltage at terminal A is high. Control unit 24 then conducts charging current from the source 16 for the ignition coil 20. Conversely, when the Hall Device is exposed to the magnet field, the conductivity of the sensor is high, the voltage level at terminal A is low and the ignition coil is blocked and is not drawing current from the charging source.

The electronic control unit 24 is a five terminal case grounded structure, three of whose terminals, labelled P+, A and G, are adapted to be connected to the corresponding terminals of the Hall Effect Device as shown, with a fourth terminal J2 of the control unit adapted to be connected to the B+ or J2 terminal on the load side of the vehicle ignition switch 28. A fifth or output terminal, labelled O, of the electronic control unit is adapted to be connected to the negative side (−) of the ignition coil 20, whose positive (+) terminal is shown connected to the run-start contact R, S of the vehicle ignition switch 28. Ignition coil 20 is a standard coil of the conventional low secondary to primary turns ratio-type, typically 100:1, as customarily employed in the ignition systems of internal combustion engines for street or passenger car automotive vehicles.

Internally, the electronic control unit 24 comprises an input stage 40, the programmed dwell or pulse delay timer stage 50, an automatic shut-down timer stage 60, a driver amplifier stage 70, an inverter stage 80, and a power output stage 90, all of which employ switching type semiconductor devices. Devices 42, 72, 82 and 92 are shown as NPN silicon transistors of which the device 92 is shown as a Darlington pair, while the devices 52 and 62 are programmable unijunction transistors, also called complementary SCR devices. Several additional solid state semiconductor devices in the form of silicon-diodes D1–D6 and a Zener diode DZ are employed in the circuit for circuit protection, temperature compensation, filtering and circuit isolation purposes.

Input transistor 42 of the input stage 40 is adapted to be connected across the B+ or supply voltage source 16 in a circuit from the J2 terminal connected through a current limiting resistor 41 to the collector electrode of transistor 42 whose emitter electrode is connected to case ground. Base current drive is supplied to transistor 42 through a voltage divider comprised of resistors 46 and 47 of which resistor 46 is connected to the J2 terminal and resistor 47 is connected to the base electrode of transistor 42 through a temperature compensation diode D2. The divider junction J is connected to the input terminal A of the electronic control unit 24 for connection to the corresponding output terminal of the Hall Effect Device 36.

The programmed dwell timer circuit 50 includes a timing capacitor 56, which may have a value of, say, 0.22 mfd, for example, and is connected in a charging circuit to be charged from B+ through resistor 41, diode D3 and resistor 51 when transistor 42 is non-conductive, the resistors 41 and 51 having assumed values of, say, 1000 ohms and 33,000 ohms, respectively. When transistor 42 is conductive, however, diode D3 is back-biased, and timing capacitor 56 is then connected in a discharge timing circuit through resistor 57, which may have an assumed value of, say, 82,000 ohms and is connected at its ungrounded side to the gate electrode of PUT device 52. At its anode electrode, PUT 52 is connected to the junction J of the voltage divider 46, 47 and its cathode electrode is connected through resistor 58 to case ground, so that it will latch into conduction when the voltage applied to its gate control electrode from the aforesaid capacitor discharging circuit falls one diode drop (0.6v) below the voltage at the divider junction. With assumed values of 4,700 ohms and 1,000 ohms for the resistors 46 and 47 and a 12.0 volt B+ source, the voltage level at the voltage divider junction J will be slightly above 3 volts, for example, considering the effect of the diode drop of the base emitter junction of transistor 42.

The automatic shut-down timer circuit 60 is similarly constituted to the programmed dwell timer circuit 60, except that the charging circuit and the discharging circuit for the timing capacitor 66 employed therein will have a much faster charging rate and a much slower discharging rate, respectively than the corresponding capacitor charging and discharging circuits of the programmed dwell timer circuit. Capacitor 66, which may have a capacitance value of 1.5 mfd for example, is connected to be rapidly charged from B+ through resistor 41 and isolation diode D4 and to discharge through resistor 67, which may have a resistance value of 1 megohm and is connected between the gate electrode of PUT device 62 and ground. PUT 62 is grounded at its cathode electrode with its anode connected to the junction J of the voltage divider 46, 47, the potential level of which thus programs the operation of the PUT 62 in relation to the potential applied to the gate electrode from the capacitor discharge timing circuit of the automatic shut-down timer 60.

Transistor 72 of the driver stage amplifier 70 has its base input electrode directly connected to the junction between resistor 58 and the cathode electrode of PUT 52. The collector electrode of transistor 72 is connected directly to the base input electrode of transistor 82 of the inverter stage amplifier 80 and also to the B+ supply terminal through a current limiting resistor 71, which provides base current drive to the transistor 82 when transistor 72 is non-conductive. The collector electrode of the inverter stage transistor 82 is connected through a current limiting resistor 81 to the B+ supply line and through an isolation diode D5 whose cathode electrode is connected to resistor 86 and to the base input electrode of the Darlington output switching transistor 92. The emitter electrode of transistor 92 is connected to case ground and its common collector electrode is connected to output terminal O for connection to the ignition coil 16.

The Darlington output transistor 92 is provided with several circuit protection networks, including a transient feedback circuit comprised of a capacitor 95 and a resistor 97, which are serially connected between its collector output and base input electrodes. This circuit suppresses leakage reactance effect of the ignition coil and eliminates the need for the large capacitor which otherwise would be connected across the output electrode to the output transistor of the breaker points as customarily employed in prior forms of ignition systems.

Another circuit, including resistors 100 and 102 and a Zener diode, Dz, is provided to protect the output switching transistor 92 from the damaging effects of the high induced voltages that may appear at the collector of the output transistor under no-load ignition coil conditions when the output transistor is not conducting. Resistors 100 and 102 are connected as a voltage divider in a circuit between the collector electrode of the output switching transistor 92 and to the B+ supply bus, while the Zener diode Dz is connected as shown between the divider junction and the base of transistor 92. Should the voltage at the collector of transistor 92 rise above the voltage rating of the zener diode, as it may during no-load or unconnected ignition coil secondary conditions, the Zener breaks down to conduct current into the base of transistor 92 to turn it on slightly and limit the rise of the voltage at its collector output.

Further protection devices are provided in the input circuit including a diode D1, which is shown connected between the J2 terminal and case ground and provides circuit protection for negative going or reverse transients appearing on the supply conductors. Protection to the Hall Device from the otherwise damaging effects of positive-going voltage transients appearing on the B+ supply line is provided by an attenuation filter 110 comprised of a resistor 112, which is internally connected between the J2 terminal and the P+ terminals of the electronic control unit, and a capacitor 114, which is connected across the P+ terminal and case ground. Capacitor 116 and diode D6, which are connected between the input terminal A and case ground of the control unit 24, provide RF suppression to protect the base of the input transistor 42.

Figure 2:
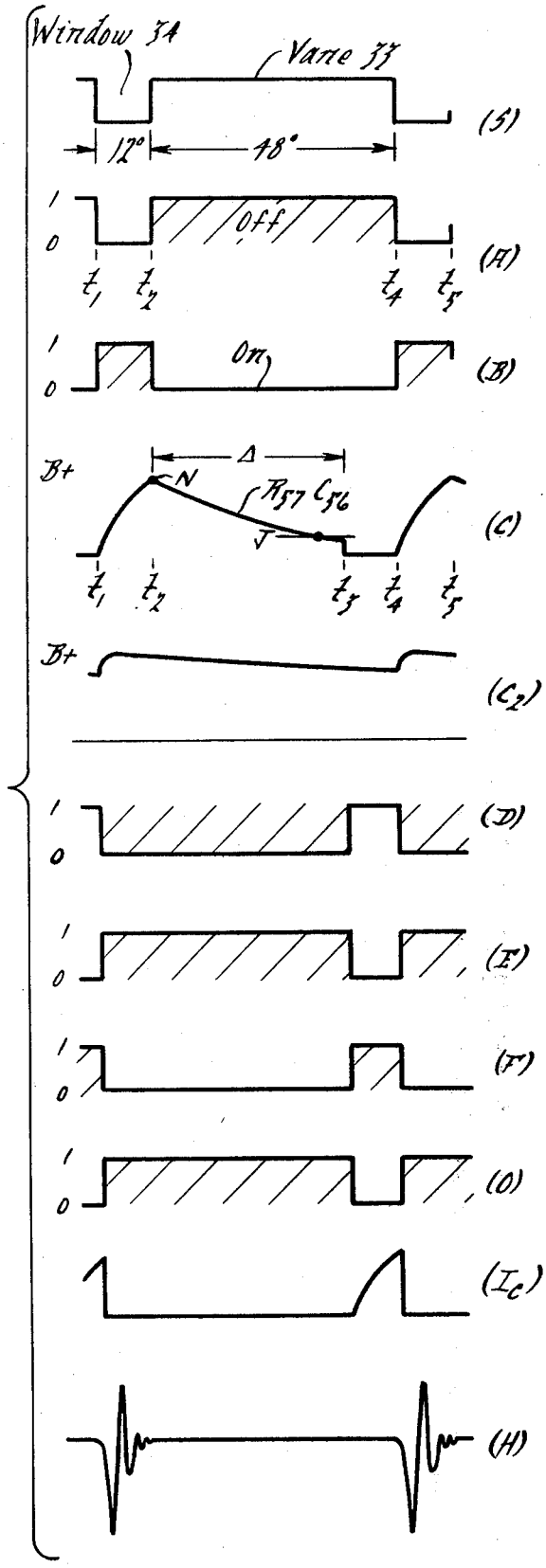
FIG. 2 depicts timing wave form signals which appear at various designated points in the circuit of FIG. 1 in relation to the position of the shutter or trigger wheel as depicted in FIG. 2(s), and are useful in understanding the operation thereof.
Figure 3:
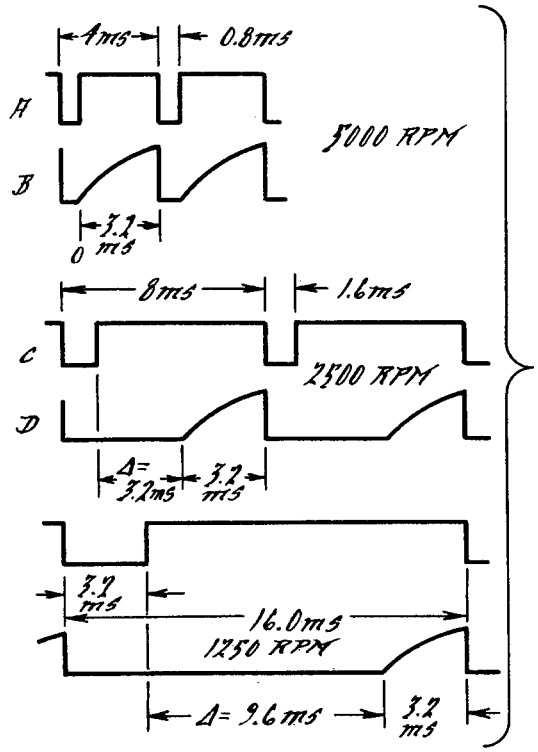
FIG. 3 depicts several additional timing wave forms useful in understanding the operation of the programmed dwell circuit of FIG. 1.

The operation of the ignition controller of FIG. 1 with the programmed dwell timer circuit may be understood from FIGS. 2 and 3. Assuming that at time *t1*, an aperture or cut-out portion 34 of the shutter wheel 32 has rotated into the air gap 37 and is positioned between magnet 38 and the Hall Effect Device 36, the conductivity of the latter will be high and its impedance or output will be low, as shown in FIG. 2A. Input transistor 42 will be deprived of base current and rendered non-conductive. The voltage at the collector electrode of transistor 42 will be high, whereby capacitor 56 will commence to charge towards B+ through resistor 41, isolation diode D3 and resistor 51 through capacitor 56 to ground. With the assumed values of resistance and capacitance for resistors 41 and 51 and capacitor 56, the charging circuit will have a charging RC time constant of approximately 7 milliseconds.

As the anode of the PUT device 52 is being held at or near ground potential by the conducting Hall Device 36, the PUT 52 will be off and render the driver stage transistor 72 non-conducting. Inverter stage transistor 82 will therefore be conducting and output transistor 92 will be non-conductive to block current draw for the ignition coil.

At time *t2*, a metallic vane portion 33 of the shutter wheel 32 will have rotated into position in the air gap 37 between the magnet 38 and the Hall Device 36, which will therefor switch to its low conductivity or high impedance characteristic to permit base current to be supplied to the input transistor 42. The latter will therefore turn on, dropping the voltage at its collector to substantially ground potential. Isolation diode D3 will then become back-biased to permit timing capacitor 56 to discharge through resistor 57, which provides a discharge time constant with capacitor 56 of approximately 18 milliseconds.

When the voltage on the gate control electrode of the programmed uni-junction transistor device 52 has dropped or decayed to a level one diode voltage drop below the programmed voltage level, say, (3.0 volts) at its anode electrode at a time depicted as *t3* in FIG. 2, the PUT latches into conduction to supply base current drive to driver amplifier transistor 72. This action turns off the transistor 82 of the inverter stage 80 and turns on the output transistor 92 to conduct current through the primary of the ignition coil 21 and commence the dwell or coil charging period, *d*, of the controller, as shown in FIG. 2I(c).

The dwell period, *d*, continues until time *t4* when the trailing edge of a vane 33 of the shutter wheel 32 passes from between the magnet 38 and the Hall Device 36 to expose the Hall Device 36 to expose the Hall Device through a window 34 to the magnet field, thereby increasing its conductivity and again dropping the voltage level at terminal A as shown in FIG. 2A. Input transistor 42, PUT 52 and driver stage transistor 72 then switch OFF, inverter stage transistor 82 switches ON, and the output transistor 92 switches OFF. Timing capacitor 56 then starts to charge again through resistors 41 and 51 to B+.

It will be seen that the programmed dwell time circuit functions to delay the turn-on of the output transistor 92 and the energization of the ignition coil from the turn on of the input transistor 42 by the shutter wheel and that the delay period, Δ, which extends from time *t2* to *t3*, is a function of engine speed. The charge level attained on the timing capacitor 56 during its charging interval from time *t1* to *t2* is a function of engine speed, and the higher the engine speed, the less time the capacitor will have to charge whereby the charge level will decrease with increasing engine speed.

It is apparent that at some engine speed the charge attained on the capacitor C56 when the shutter switches input transistor ON again, will only be 2.4 volts or one diode drop below the programmed voltage at the anode of PUT 52 so that PUT 52 will switch directly ON and OFF with the shutter at this speed. The controller switches ON and OFF with the shutter wheel, and the system reverts to a constant duty cycle system. With reference to FIGS. 3A–F, assuming that the engine speed is 5000 rpm, the delay, Δ, at that speed will be zero to provide a dwell period for the charging of the coil of 3.2 ms, as indicated in FIG. 3B. At 2,500 rpm, both the dwell and the delay will be 3.2 milliseconds as shown at 3 C & D, and at 1,250 rpm, the delay, Δ will be 9.6 milliseconds as shown in FIGS. 3E and F in order to provide a substantially constant period of energization of the ignition coil of 3.2 milliseconds for the aforesaid 6 vane 48°/60° or 80% duty cycle shutter used with a six cylinder engine.

Figure 4:
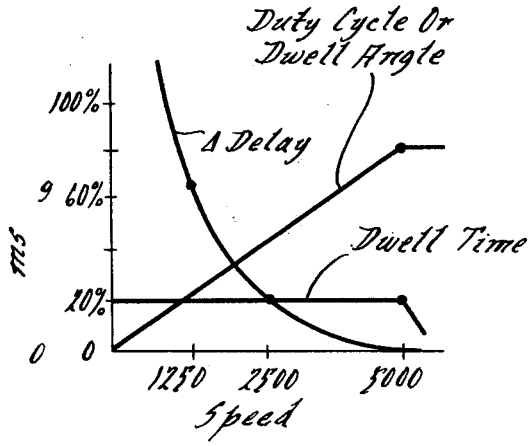
FIG. 4 depicts the delay, dwell and duty cycle versus engine speed characteristics of the programmed dwell circuit employed in FIG. 1.

With reference to FIG. 4 it will be seen that the delay, Δ, varies as an inverse function of engine speed, while the duty cycle of the controller increases with engine speed up to a high engine speed of say, 5,000 rpm after which the duty cycle of the controller is determined solely by the physical geometric characteristics of the shutter wheel and reverts to a constant duty cycle or ON/OFF time period. The actual dwell time *d* as a percentage of the ignition cycle remains constant over the substantially entire range of engine speed until an engine speed of 5,000 rpm at which speed the actual dwell time decreases accordingly.

By way of comparison, it will be noted that the timing capacitor 66 of the automatic shut-down timer circuit 60 has a much faster charging period than the charging circuit for the capacitor 56 of the programmed dwell circuit 50 and becomes fully charged during the interval *t1* to *t2* when the window 34 of the shutter wheel 32 is positioned in the air gap between the permanent magnet 38 and the Hall Effect Device 36. Also as shown at (C2) in FIG. 2, the discharge period of the timing capacitor 66 of the automatic shut-down circuit is much slower than that of the discharge timing circuit of the programmed dwell circuit 60. In the illustrated embodiment of the circuit, the discharge time constant of the shut-down circuit is in the order of 1.5 seconds as compared to the 18 millisecond discharge time constant of the programmed dwell circuit. Consequently, the programmed uni-junction transistor or PUT device 62 of the automatic shut-down circuit 60 does not turn on during normal operation of the controller circuit while, or so long as the shutter wheel is rotating.

In the event the engine should stop with the shutter wheel 32 positioned with a vane 33 in the air gap 37 of the Hall Device, the input transistor 42 will be left in a conducting condition and output transistor 92 will turn ON after the delay period afforded by or the RC discharge timing circuit of the programmed dwell circuit has timed out. Because of the considerably longer discharge time period of the RC discharge timing circuit of the automatic shut-down time circuit, the capacitor 66 of the latter circuit continues to discharge until the potential at the gate control electrode of PUT 62 falls one diode voltage drop below the programmed voltage of its anode electrode. At such time, PUT 62 is actuated to drop the voltage at the divider junction J at or near ground and turn off transistor 42 as well as PUT 52 of the programmed dwell circuit. This action results in turning OFF the driver stage transistor 72, turning on the inverter stage transistor 82 and cutting off the output switching transistor 92, thereby turning OFF the energization of the ignition coil. The PUT device 52 stays on even though the shutter vane is still in the air gap 37 between the magnet and the Hall device until such time as the engine is subsequently cranked and the shutter vane is moved out of the air gap, at which point in time and space the PUT 52 is quenched and turned off, as shown and more fully discussed in related copending application U.S. Ser. No. 743,021, filed of even date and of common ownership herewith, U.S. Pat. No. 4,106,460.

What is claimed is:

1. In a breakerless electronic ignition system including a triggerable electronic ignition controller for an internal combustion engine having a source of low tension electrical energy, at least one sparking device and an ignition coil having a primary winding connected for energization from said source and another winding for supplying high tension energy to said sparking device, said controller adapted to be triggered from an engine-driven pickup device developing substantially rectangular-shaped electrical signal pulses of a pulse repetition rate proportional to engine speed and a fixed duty cycle or ratio of ON to ON and OFF period, said controller comprising a first controllable semiconductor switching means adapted to be connected in series with the primary winding of the ignition coil directly across the source to receive the full voltage of said source across the said coil primary winding without any external current limitation upon conduction of said first controllable semiconductor switching means, second controllable semiconductor switching means adapted to receive trigger signal pulses from said pickup device to change its state of conduction from one state to its other state directly in accordance with the ON period and OFF period of said signal pulses, said second semiconductor switching means being in one state of conduction when said first semiconductor switching means is in its conduction state and coupled in conductivity controlling relation to said first semiconductor switching means to change the conduction state of the latter when the conduction state of the second semiconductor switching means is changed by said trigger signal, and time delay switching means coupled between said second and first controllable semiconductor switching means and operable to block conduction of said first semiconductor switching means during an initial portion of the said one state of conduction of said second semiconductor switching means and to delay the return to conduction of the first controllable semiconductor switching means from the return of said second controllable semiconductor switching means to its said one state for a controlled delay period which is a function of engine speed and prevents dissipation of energy in the coil at low engine speeds without impairment to the dwell period of the controller at high engine speeds, said time delay switching means including a timing capacitor connected to be charged from said energy source in a circuit in parallel with the energization circuit of the ignition coil primary winding and serially-connected first controllable semiconductor switching means.

2. Apparatus in accordance with claim 1 above wherein said delay period is less than the actual dwell time of the electronic ignition controller at midrange to high engine speeds.

3. Apparatus in accordance with claim 1 above in which the said controlled delay period varies as a function of engine speed.

4. Apparatus in accordance with claim 3 above wherein, after the expiration of said controlled delay period, the ignition coil is energized for a substantially constant period of time over the entire range of engine operating speeds up to a predetermined high engine speed.

5. Apparatus in accordance with claim 3 above wherein said controlled delay period decreases as engine speed increases.

6. Apparatus in accordance with claim 4 above wherein said electronic ignition controller exhibits a variable dwell angle characteristic which increases with engine speed up to a predetermined high engine speed and thereafter reverts to a constant dwell angle or duty cycle characteristic.

7. Apparatus in accordance with claim 6 above wherein said electronic ignition controller provides a speed dependent variable dwell angle characteristic, but a speed independent substantially constant dwell time characteristic up to a predetermined high engine operating speed at or near the upper end of the operating speed range of the engine.

8. Apparatus in accordance with claim 4 above wherein said controlled delay period is less than the actual dwell time of the electronic ignition controller at midrange to high engine speeds, but is greater than the actual ignition cycle dwell time at low to midrange engine speeds.

9. Apparatus in accordance with claim 4 above wherein said controlled delay period varies from minimum or zero at a predetermined high engine speed to from about 20 to 30 milliseconds at low engine speeds above engine cranking.

10. Apparatus in accordance with claim 1 above wherein said time delay switching means timing capacitor is connected in a capacitor charging circuit adapted to be charged from said source of energy through a first resistor when the second controllable semiconductor switching means is in a non-conductive state and is connected in a relatively slower capacitor discharging circuit to be discharged through a second resistor when said second controllable semiconductor switching means is in a conductive state, said capacitor discharging circuit having an RC discharge time constant of at least twice the RC time constant of said capacitor charging circuit.

11. Apparatus in accordance with claim 10 above wherein the charge level attained on said timing capacitor while it is connected in said charging circuit is a function of engine speed.

12. Apparatus in accordance with claim 1 wherein said second controllable semiconductor switching means is a transistor having collector, base and emitter electrodes and wherein said time delay switching means includes a timing capacitor, which is connected to the collector electrode of said second transistor and is adapted to be charged from said source of energy through a first resistor connected between the collector electrode of said second transistor and said timing capacitor, a second resistor connected in parallel with said timing capacitor and providing a discharge circuit therefor when said second transistor is in a conductive state, and a third controllable semiconductor switching device set to operate at a predetermined voltage level with its output electrodes connected in a circuit which directly controls the conductivity of said first controllable semiconductor switching means and having its control electrode connected to said timing capacitor.

13. Apparatus in accordance with claim 12 above including an isolation diode connected between the collector electrode of said second transistor and the timing capacitor and wherein said isolation diode is back-biased to permit the timing capacitor to discharge through the second resistor when the second transistor is conductive.

14. Apparatus in accordance with claim 12 above wherein said third controllable semiconductor switching device is a voltage latching conduction device.

15. Apparatus in accordance with claim 14 wherein said voltage latching conduction device is a programmable uni-junction transistor device.

16. Apparatus in accordance with claim 15 including a voltage divider connected between the base of the second transistor and a terminal of the electronic control unit which is adapted to be connected to the high potential side of said source of energy and wherein said programmable unijunction transistor has its anode connected to the junction of the voltage divider, its gate control electrode connected to the timing capacitor and its cathode electrode coupled to the first semiconductor switching means.

17. Apparatus in accordance with claim 16 above wherein the cathode electrode of said programmable unijunction transistor device is coupled to the first controllable semiconductor switching means through a pair of intervening transistor stages.

18. Apparatus in accordance with claim 17 above wherein said pair of intervening transistor stages are direct current conductively connected and are each connected in a common emitter configuration.

19. Apparatus in accordance with claim 1 above wherein said electronic control unit is adapted to be triggered from a velocity insentive pickup device, such as a Hall sensor switch.

20. Apparatus in accordance with claim 19 above wherein said Hall sensor switch device includes an apertured shutter wheel adapted to be rotatively driven from the engine and providing spaced electrical trigger pulse signals therefrom having a duty cycle of around 80% for at least a six cylinder engine.

21. Apparatus in accordance with claim 20 above wherein the shutter wheel has a plurality of equidistant arcuately spaced slots therein each of approximately 12 mechanical degrees in arcuate extent about the periphery or circumference of the shutter wheel and spaced apart an arcuate distance of approximately 48°.

22. Apparatus in accordance with claim 16 wherein said electronic ignition controller includes a second time delay switching means which is connected to the second transistor and includes a second timing capacitor connected to the collector electrode of the second transistor to be rapidly charged from said source of energy through a third resistor when the second transistor is non-conductive and is connected in a discharging circuit through a fourth resistor which is connected in parallel with the second timing capacitor to be slowly discharged when the second transistor is rendered conductive, and a second programmable unijunction transistor device having its anode electrode connected to the junction of the voltage divider, its gate control electrode connected to the second timing capacitor and its cathode electrode connected to the terminal of the electronic control unit coupled to the other side of the potential source, whereby both the first mentioned and said second programmable unijunction transistor devices are programmed from the same voltage divider.

23. Apparatus in accordance with claim 22 wherein said second time delay switching means is operative to change the state of conduction of said second transistor and render said first controllable semiconductor switching means non-conductive when said second transistor remains in a state of conduction which renders said first controllable semiconductor switching means conductive for a period of time which is several times greater than the dwell period of the ignition cycle at engine cranking speeds.

24. A triggerable electronic ignition controller for an internal combustion engine having a source of low tension electrical energy, at least one sparking device and an ignition coil having a secondary winding for supplying high tension energy to said sparking device and a primary winding connected at one side for energization from said source, said controller triggerable from an engine-driven pickup device developing substantially rectangular-shaped signal pulses of a pulse repetition rate proportional to engine speed and a fixed duty cycle or ratio of ON to ON and OFF period, and comprising a first controllable semiconductor switching means for connection to the other side of the primary winding of the ignition coil, second controllable semiconductor switching means for reception of said trigger signal pulses from said pickup device to change its state of conduction from one state to its other state directly in accordance with the ON period and OFF period of said signal pulses, said second semiconductor switching means being in one state of conduction when said first semiconductor switching means is in its conduction state and coupled in conductivity controlling relation to said first semiconductor switching means to change the conduction state of the latter when the conduction state of the second semiconductor switching means is changed by said trigger signal, and time delay switching means coupled between said second and first controllable semiconductor switching means and operable to block conduction of said first semiconductor switching means during an initial portion of the said one state of conduction of said second semiconductor switching means to delay the return to conduction of the first controllable semiconductor switching means from the return of said second controllable semiconductor switching means to its said one state for a controlled delay period which is a function of engine speed, said time delay switching menas including a timing capacitor connected to be charged from said energy source in a circuit in parallel with the energization circuit of the ignition coil primary winding and serially connected first controllable semiconductor switching means.

* * * * *